US008151382B1

(12) United States Patent
Kennedy

(10) Patent No.: US 8,151,382 B1
(45) Date of Patent: Apr. 10, 2012

(54) BATHTUB SHORTENER AND POSITION STABILIZER

(76) Inventor: Diana Kennedy, Lisle, IL (US)

( * ) Notice: Subject to any disclaimer, the term of this patent is extended or adjusted under 35 U.S.C. 154(b) by 411 days.

(21) Appl. No.: 12/454,723

(22) Filed: May 21, 2009

Related U.S. Application Data

(60) Provisional application No. 61/130,109, filed on May 28, 2008.

(51) Int. Cl.
*A47K 3/024* (2006.01)

(52) U.S. Cl. ..... 4/571.1; 4/514

(58) Field of Classification Search ..... 4/514, 559, 4/571.1, 573.1–575.1, 578.1–579, 659; 248/206.3
See application file for complete search history.

(56) References Cited

U.S. PATENT DOCUMENTS 1,817,330 A * 8/1931 Wilson, Jr. ..... 4/514
4,400,835 A 8/1983 Richter
5,063,621 A 11/1991 Sellars
5,249,316 A * 10/1993 Macchiavello ..... 4/559
5,481,764 A * 1/1996 Nelson ..... 4/559
6,370,710 B1 * 4/2002 Haury et al. ..... 4/514
7,152,256 B1 12/2006 Roberts
2006/0138392 A1 * 6/2006 Bowden et al. ..... 257/1
2010/0071124 A1 * 3/2010 Ammirato ..... 4/573.1

* cited by examiner

*Primary Examiner* — Charles Phillips
(74) *Attorney, Agent, or Firm* — Emary L. Tracy

(57) ABSTRACT

A bathtub shortener and position stabilizer for maintaining a user in an upright position and inhibiting the motion of sliding out of an upright position while bathing in a bathtub is provided. The bathtub shortener and position stabilizer comprises a main body having at least one side wall, a top wall, and a mounting wall. A combination foot rest and foot pad is securable to one of the side walls of the main body. A securing mechanism secured to the mounting wall of the main body releasably secures the main body to the bathtub in a position contactable by the user wherein the combination foot rest and foot pad are constructed from softer material than the main body and wherein upon releasably securing the main body to the bathtub, the combination foot rest and foot pad face the user allowing the user to contact the combination foot rest and foot pad thereby maintaining the user in an upright position.

10 Claims, 13 Drawing Sheets

BATHTUB SHORTENER AND POSITION STABILIZER

The application claims the benefit of priority of provisional patent application Ser. No. 61/130,109, filed on May 28, 2008, entitled "Bathtub Slide Preventer".

BACKGROUND OF THE INVENTION

1. Field of the Invention

This invention relates generally to a bathtub shortener and position stabilizer and, more particularly, the invention relates to a bathtub shortener and position stabilizer providing an easier and more comfortable way to enjoy a long bath especially for children and adults of short stature and people who have large bathtubs.

2. Description of the Prior Art

Bathing can be one of the most enjoyable and invigorating activities of the day. Providing an eye-opening renewal, taking a shower upon waking is, for many, a preferred method of greeting the morning. Allowing the cool, pulsating spray of the water to cascade over the face and to gently massage the neck, shoulders and back can be a delightful energizer even for the groggiest of people. Conversely, many more may favor a luxurious bath at the end of hectic and busy days. Soaking in a bathtub full of warm, scented water and surrounded by fragrant caressing bubbles can provide a much needed respite for the mind, body, and spirit. Adding to the relaxing ambiance, some may sprinkle cleansing and soothing bath salts into the water and encircle the perimeter of the tub with aromatic, flickering candles. Settling in to soak away the cares and worries of the day, those who enjoy a long hot bath often find this the perfect time to lose themselves in a favorite magazine or the latest best-selling novel, listen to soft musical sounds coming from a stereo, or even enjoy a glass of wine. Free from the distractions of a busy household, engaging in these activities while bathing allows many to be entertained while they relax.

Whether reading, enjoying music, or simply lying supine in the water, bathing can sometimes present a drawback. Particularly, it can sometimes be difficult to retain a comfortable, secure position in a wet, slippery bathtub, especially for children and adults of short stature. The hard porcelain of the tub is not the most relaxing surface on which to rest the body for an extended period of time, and these consumers more often than not find themselves continuously sliding forward while in the tub. As a result, efforts to get the most out of a nice long bath can prove daunting and frustrating.

SUMMARY

The present invention is a bathtub shortener and position stabilizer for maintaining a user in an upright position and inhibiting the motion of sliding out of an upright position while bathing in a bathtub. The bathtub shortener and position stabilizer comprises a main body having at least one side wall, a top wall, and a mounting wall. A combination foot rest and foot pad is securable to one of the side walls of the main body. A securing mechanism secured to the mounting wall of the main body releasably secures the main body to the bathtub in a position contactable by the user wherein the combination foot rest and foot pad are constructed from softer material than the main body and wherein upon releasably securing the main body to the bathtub, the combination foot rest and foot pad face the user allowing the user to contact the combination foot rest and foot pad thereby maintaining the user in an upright position.

Numerous other advantages and feature of the invention will become readily apparent from the following detailed description of the invention and the embodiments thereof, the claims, and from the accompanying drawings.

Figure 4:
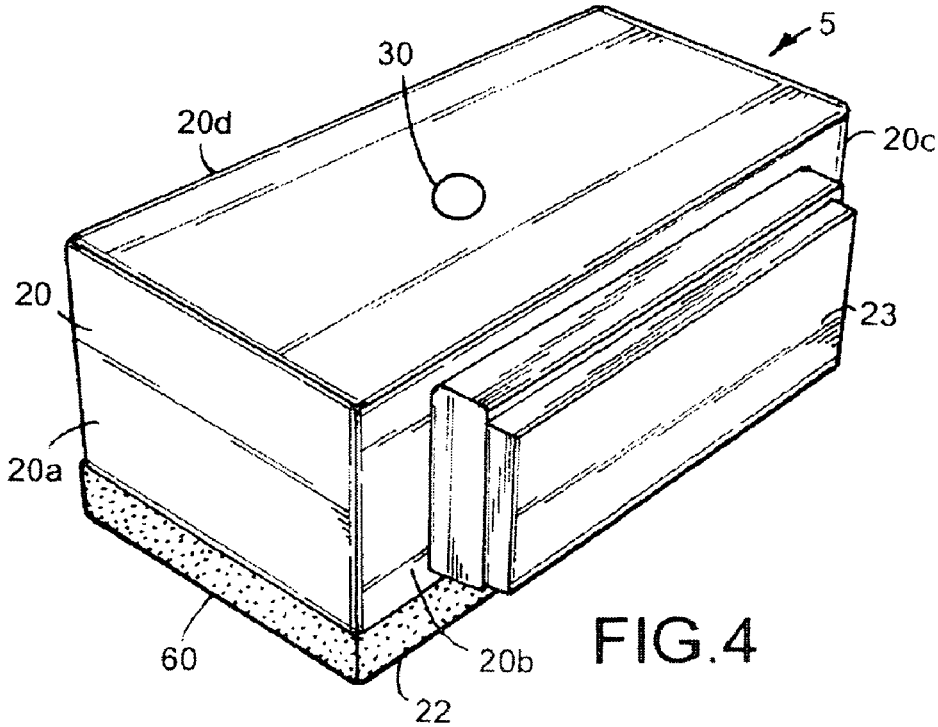
Figure 5:
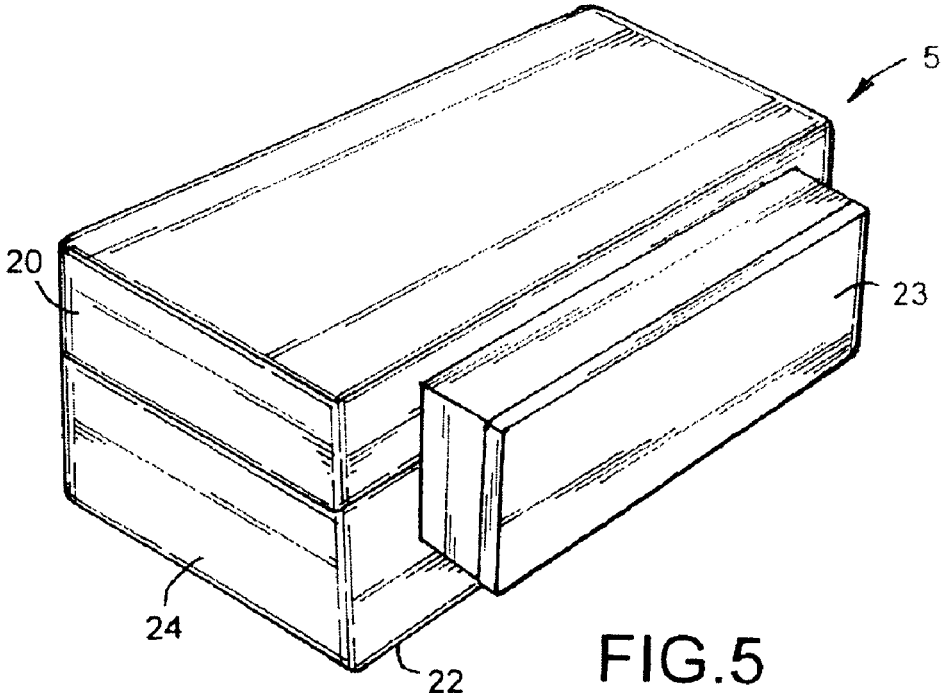
Figure 6:
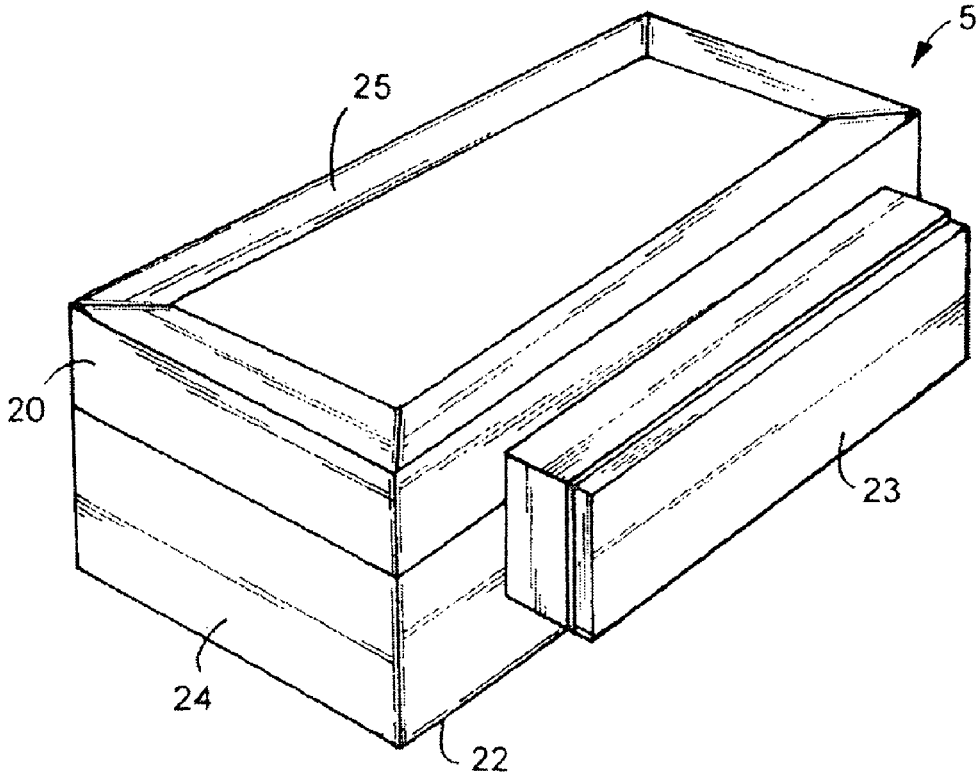
Figure 7:
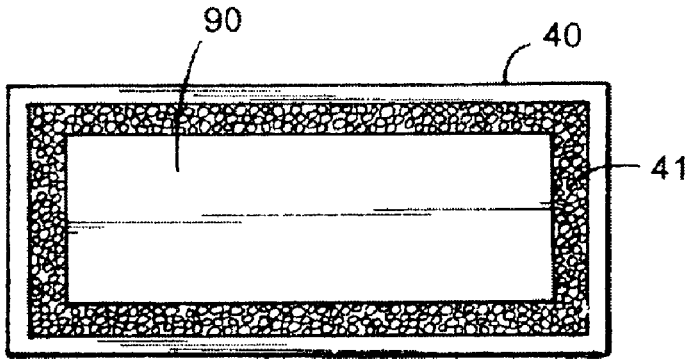
Figure 8:
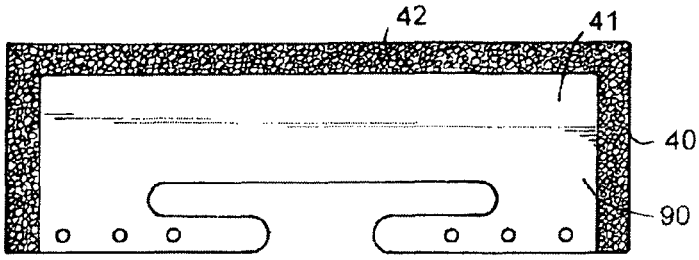
Figure 9:
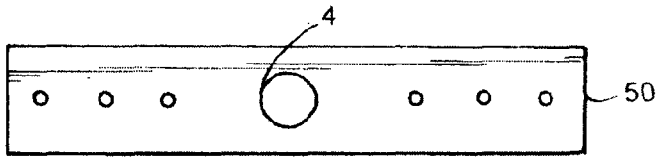
Figure 10:
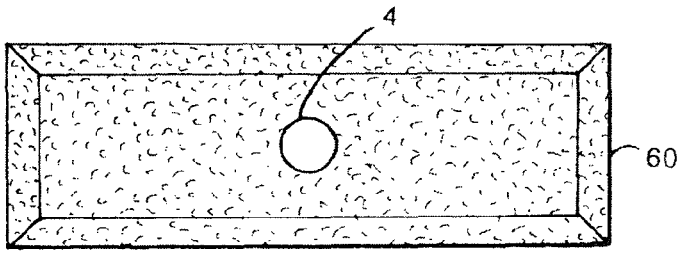
Figure 11:
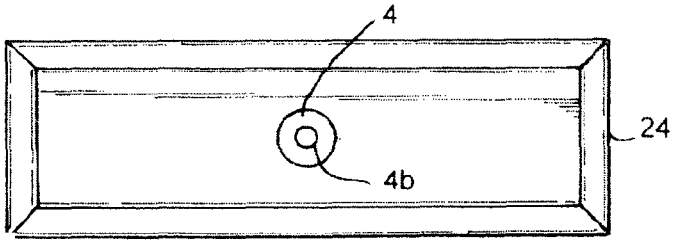
Figure 12:
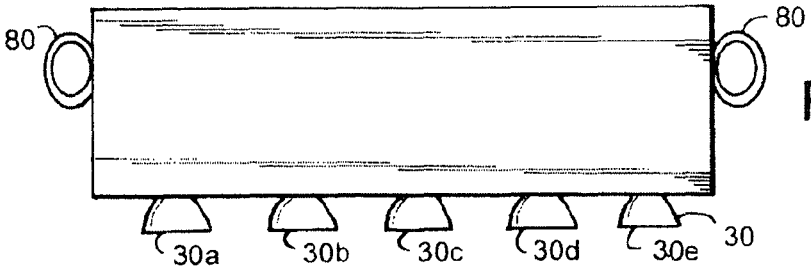
Figure 13:
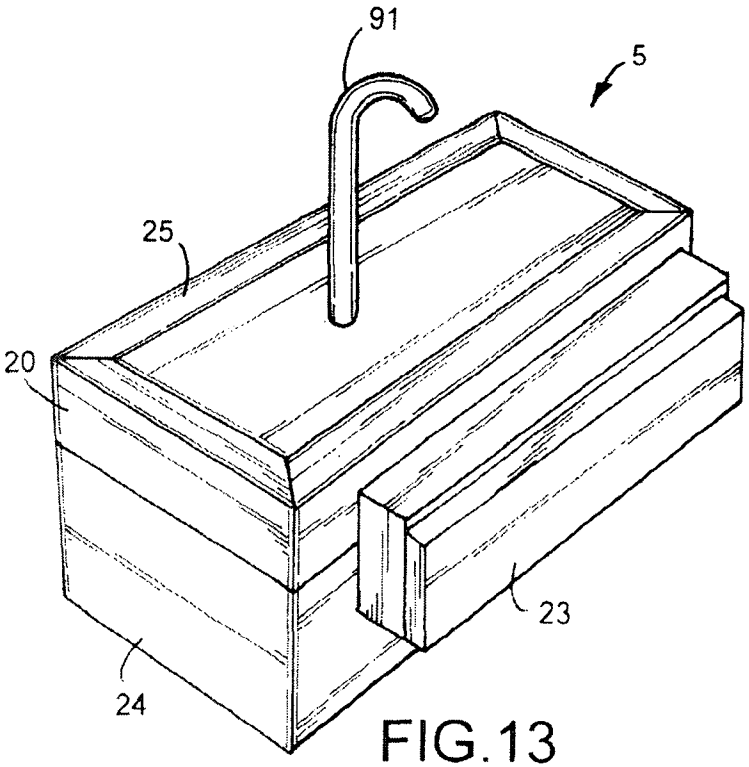
Figure 16:
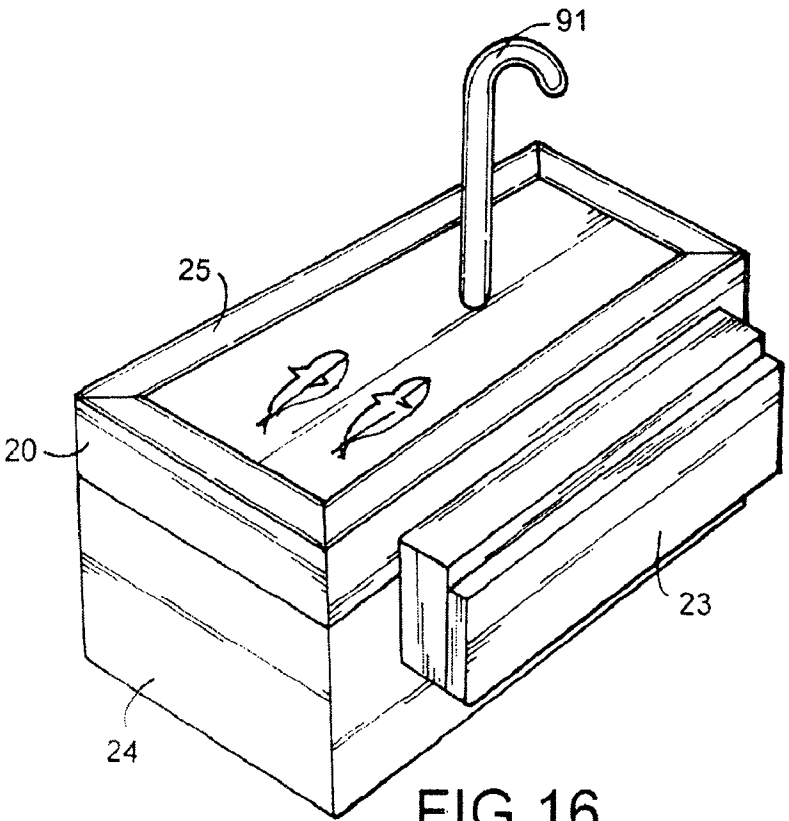
Figure 20:
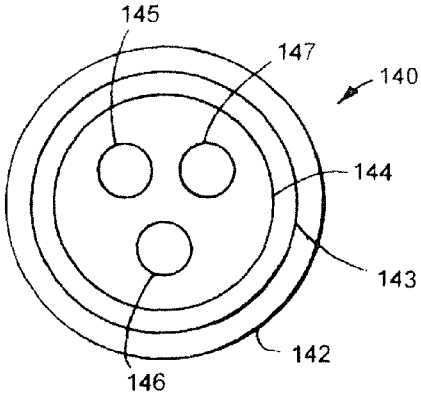
Figure 21A:
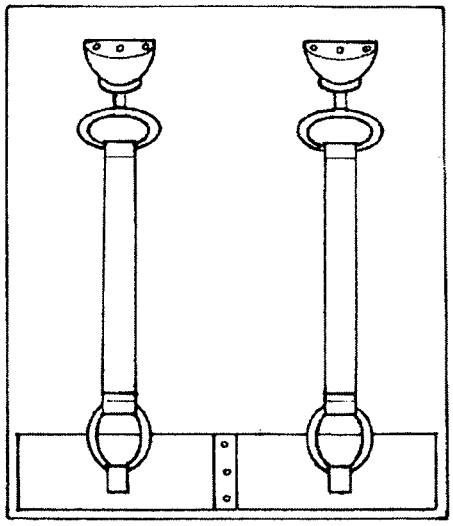
Figure 21B:
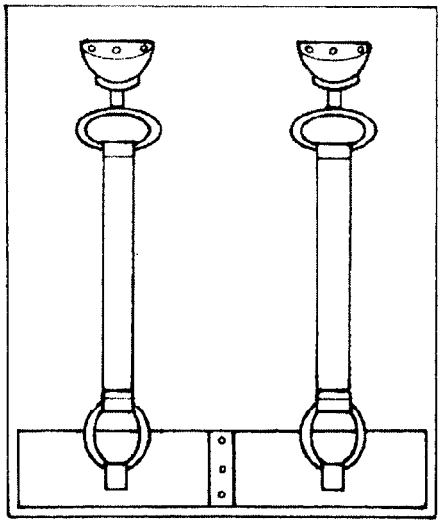
Figure 21C:
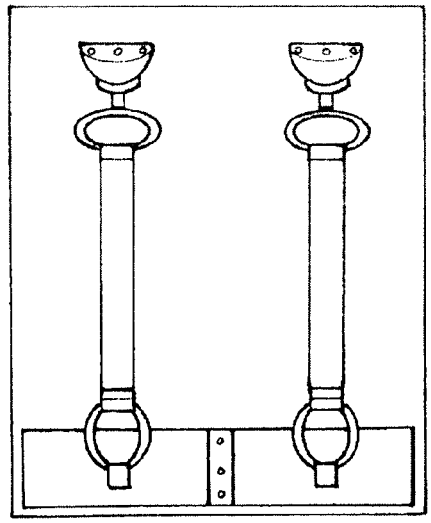
Figure 21D:
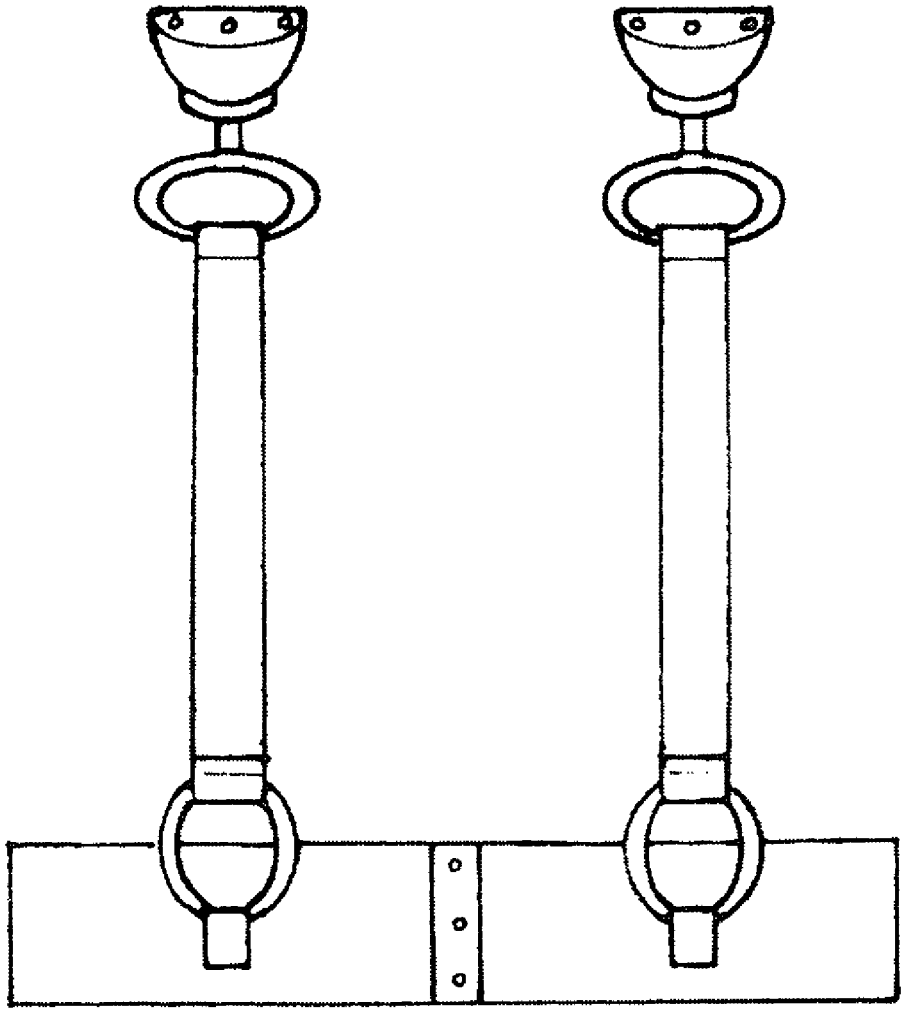
Figure 22:
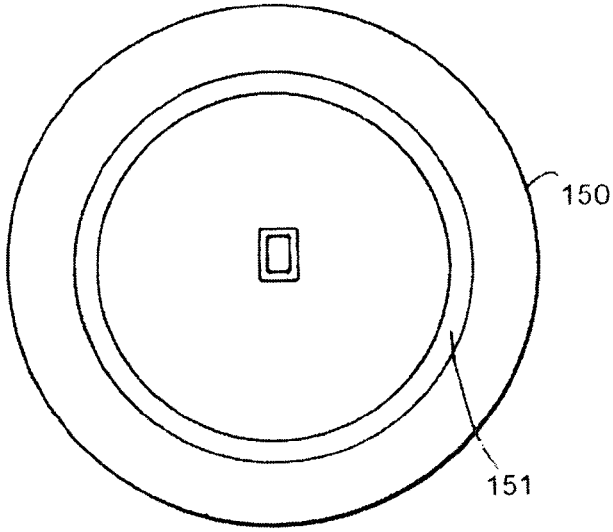
Figure 23:
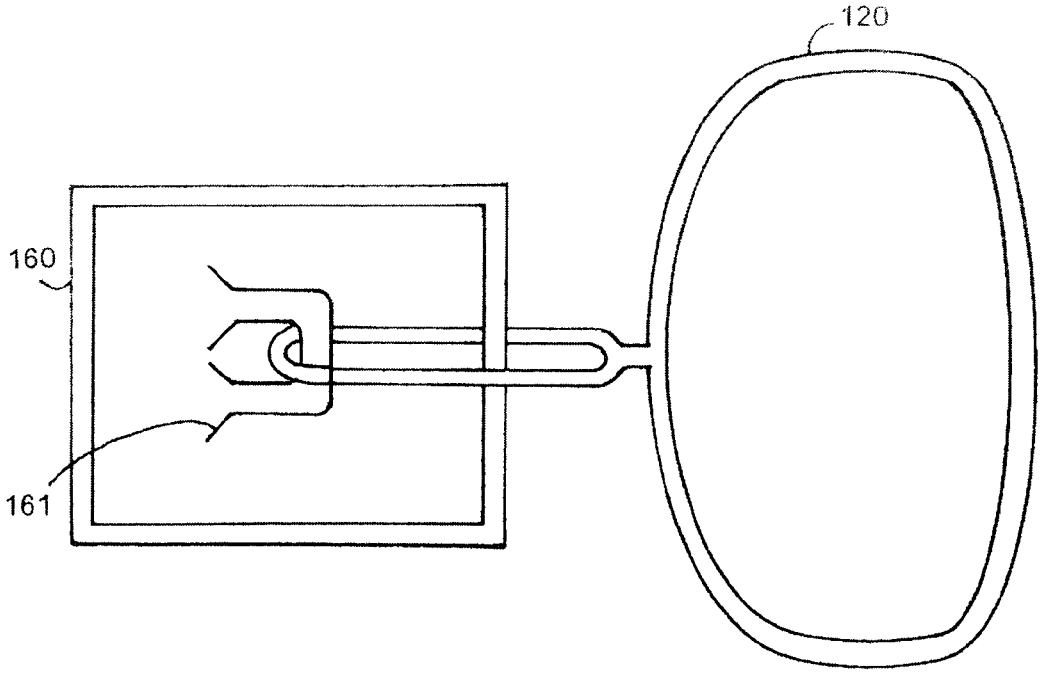

constructed in accordance with the present invention, with a close-up view of the bathtub shortener and position stabilizer in the bathtub in use;

FIGS. 4-6 are perspective views illustrating the preferred embodiment of the bathtub shortener and position stabilizer, constructed in accordance with the present invention;

FIGS. 7 and 8 are cross-sectional views illustrating the bathtub shortener and position stabilizer, constructed in accordance with the present invention;

FIGS. 9-11 are top planar views illustrating the bottom of the bathtub shortener and position stabilizer, constructed in accordance with the present invention;

FIG. 12 is a side view illustrating the bathtub shortener and position stabilizer, constructed in accordance with the present invention;

FIGS. 13 and 16 are perspective views illustrating other embodiments of the bathtub shortener and position stabilizer, constructed in accordance with the present invention;

FIGS. 14, 15, 17, and 18 are cross-sectional views illustrating the bathtub shortener and position stabilizer of embodiments of FIGS. 13 and 16, constructed in accordance with the present invention;

FIGS. 19A-19D are FIG. 19 is a perspective views view illustrating a further embodiment of the bathtub shortener and position stabilizer, constructed in accordance with the present invention;

FIG. 20 is a top plan view illustrating an embodiment of one form of the attachment mechanism, suction cups, using suction to cause adherence to the bathtub or other objects;

FIGS. 21A-21D are views illustrating another embodiment of the bathtub shortener and position stabilizer of FIG. 19, constructed in accordance with the present invention, with the safety straps being green, pink, yellow, and blue, respectively;

FIG. 22 is an end view illustrating suction attachment mechanism for the safety straps of the bathtub shortener and position stabilizer, constructed in accordance with the present invention;

FIG. 23 is a top view illustrating another attachment mechanism for the safety straps of the bathtub shortener and position stabilizer, constructed in accordance with the present invention;

FIGS. 24A-24D are perspective views illustrating a second type of construction of the bathtub shortener and position stabilizer, constructed in accordance with the present invention; and FIGS. 25*a*-25*d* are perspective views of the different decor of the bathtub shortener and position stabilizer, constructed in accordance with the present invention.

DETAILED DESCRIPTION OF THE PREFERRED EMBODIMENTS

As illustrated in FIGS. 1-25*c*, the present invention is a bathtub shortener and position stabilizer, indicated generally at 5, for providing an easier and more comfortable way to enjoy a bath which is especially beneficial for children and adults of short stature and people who have large bathtubs. The bathtub shortener and position stabilizer 5 of the present invention is well suited for adults who are four (4') feet, four (4") inches to five (5') feet, four (4") inches tall although adults who are taller that five (5') feet, four (4") and children can also use the bathtub shortener and position stabilizer 5.

In an embodiment, as best illustrated in FIGS. 4-12, the bathtub shortener and position stabilizer 5 is comprised of a main body 20 and a combination foot rest and foot pad 23. The foot rest and foot pad 23 can be secured to the main body 20 as a one-piece unit or the foot rest and foot pad 23 can be removably attached to form a two-piece unit. Preferably, the bathtub shortener and position stabilizer 5 is rectangular in cross-sectional shape measuring at least six (6") inches in length, at least twenty-one (21") inches in width, and at least ten (10") inches in depth with rounded edges. These dimensions will fit most alcove and built-in tubs and will likely fit other shaped and sized tubs, however, other dimensions to create a better fit are within the scope of the present invention.

The walls 20*a*-*d* of the main body 20 have an inner layer 41 and an outer layer 40. The inner layer 41 is preferably constructed of an inner durable, waterproof, heavy-duty plastic material, which is surrounded by the outer layer 40 that is made of the same material or a durable, waterproof, softer plastic material to provide comfort to the user. The outer layer 40 is preferably a multi-layer of softer plastic; however, a thick single layer is also contemplated. The space 42 between the inner 41 and the outer 40 layers is preferably filled with a high density material such as gel, gravel, sand, brick, granite, cement, other like material, or a combination in order to give the invention weight to help keep the invention at its intended position while the bathtub is in use. The space 90 can also be filled with water.

As illustrated in FIGS. 9-11, the bathtub shortener and position stabilizer 5 has a base or bottom 22 secured to the main body. There are several embodiments of the base 22. First, the base or bottom 50 can be constructed of similar material as the inner layer of the body wall. Second, the base or bottom 60 can be constructed of brick, granite, cement, or other like material, or a combination. FIG. 11 illustrates a third embodiment constructed of rubber or a soft material; soft plastic, other like material, or a combination. FIG. 12 illustrates a soft covering or mitt 24 that envelops the bottom 60 of the second embodiment and surrounds at least a portion, i.e., four (4") inches, of the body's plastic walls 20*a*-*d*. The mitt 24 is constructed of a soft material, such as rubber, soft plastic, other like material, or a combination. The mitt in FIG. 12 as well as the soft covering in FIG. 11 hides the abrasiveness of the bottom 60 and therefore provides a more comfortable texture to a user's touch while using the bathtub shortener and position stabilizer 5 as well as preventing scratching of the bathtub surface while in use. It is envisioned that the mitt in FIG. 12 will be used if the soft bottom in FIG. 11 is not use.

Located on the longitudinal body wall 20*b* of the body 20 and facing the user is a foot rest 23 that is either built as part of the body 20 or can be a releasable attachment to the body 20. The combination foot rest and foot pad 23 is preferably constructed of a semi-hard plastic surrounded by a softer exterior plastic, just as the body 20 walls. However, the foot rest and foot pad 23 can be constructed of other material such as rubber, or a sponge or sponge-like material, that provides support to the user but also be comfortable to touch. Some examples of sponge or sponge-like material are sisal fiber, vegetable fiber, sea sponge, flocked sponge, cellulose, polyurethane foam sponge, mesh sponge.

If the combination foot rest and foot pad 23 which can also be depicted through FIG. 11 can be removably attached to the bathtub shortener and position stabilizer by means of a screw which is inserted in a hole 4*b* extending through the main body 20, which can be seen in FIGS. 4 and 8-10. A removably attached foot rest 23 allows a user to change the foot rest 23 when a new one is needed, especially for a foot rest 23 that is not made of a plastic material, which is more durable that those made of nylon, rubber or sponge or sponge-like material.

At least one suction cup 30 is attached to the base or bottom of the mitt (FIG. 12) in order to adhere the invention to the bathtub thereby keeping the bathtub shortener and position stabilizer 5 stationary while in use. FIG. 12 illustrates five suction cups 30*a*-*e* with the suction cups preferably at least three-fourths (¾") inch in diameter and preferably located at each of the four corners of the base and with one or two suction cups in the center of the base 22. The number of suction cups 30 will vary depending upon the size and shape of the bathtub shortener and position stabilizer 5 and the type of tub being used as tubs like Jacuzzi tubs with jets produce pressure on the bathtub shortener and position stabilizer 5 that is absent in other tubs. FIG. 11 also has these circular suction rings on the bottom to help keep in place while in use. Rubber or plastic handles 80 can be attached to the body or built as part of the body 20 to assist in the transport and placement of the invention.

FIGS. 6 and 7 portray another embodiment of the bathtub shortener and position stabilizer 5 of the present invention, where the top of the body 20 is a removable lid 25. The lid 25, when opened, reveals a storage compartment 90 inside the body 20. In order to accommodate the storage compartment 90, the inner hard plastic layer is made thinner. The storage compartment can easily hold washcloths, soap, and other bathing articles.

Figure 14:
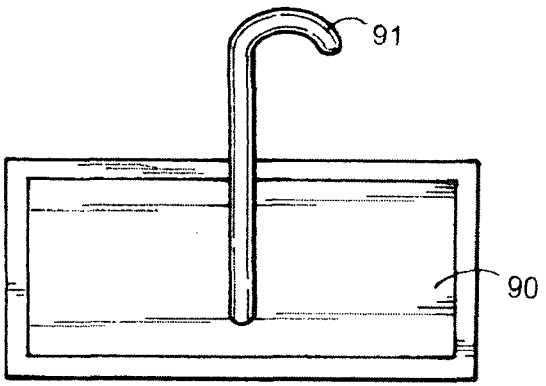
Figure 15:
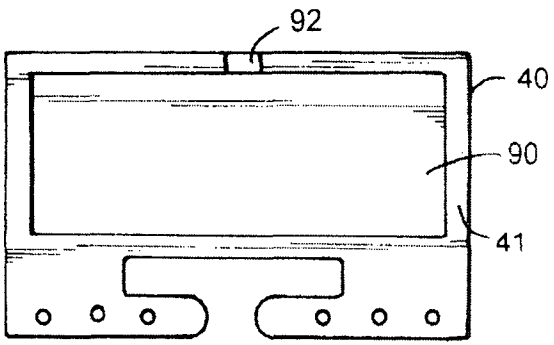

FIGS. 13-15 depict a further embodiment, where a circular cut 92 has been made into the lid 25, which can be removed in order to insert a soap dispenser pump 91 there by permitting a user to use the storage compartment 90 as a soap dispenser.

Figure 17:
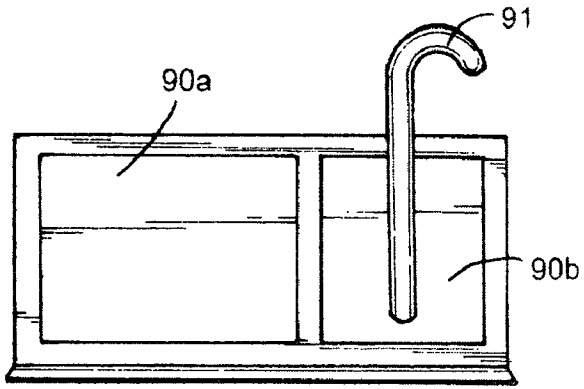
Figure 18:
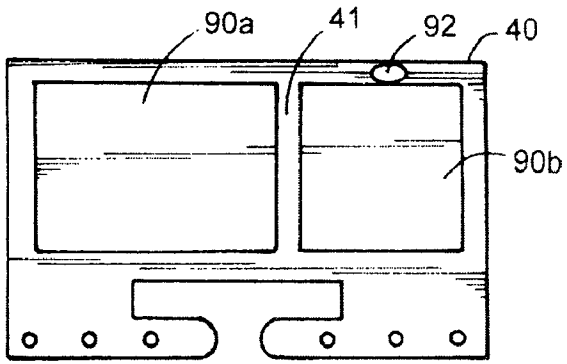
Figure 19D:
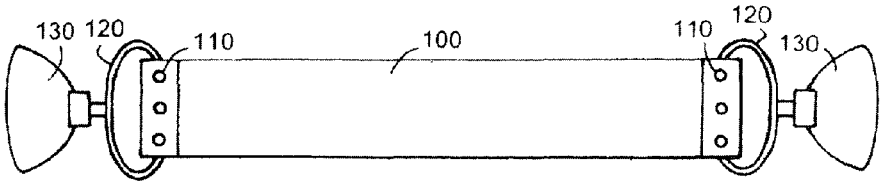
Figure 19B:
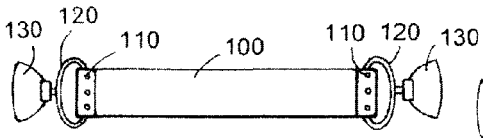
Figure 19A:
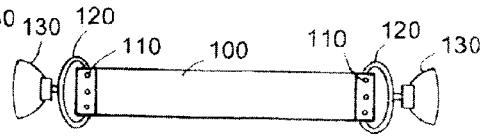
Figure 19C:
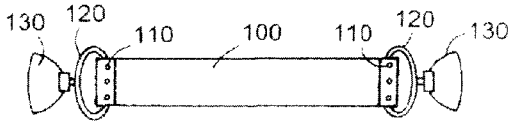

FIGS. 16-18 depicts another embodiment, where instead of one large storage compartment 90 there are two smaller compartments 90*a*-*b*. The two compartments 90*a, b* are separated by an extension of the inner semi hard plastic layer 41 of the body 20 walls. Both compartments 90*a, b* can be used as storage or one can be used as soap dispenser by removing the circular cut 92 and inserting a soap dispenser pump 91 attachment.

In a further embodiment of the invention, safety straps or safety belts 100 are used alone or in conjunction with the bathtub shortener and position stabilizer 5. FIG. 19 depicts the overall structure of the strap 100. The strap 100 is designed and shaped to go around the chest or torso of the user in order to hold the user stationary and to prevent the user from sliding out of an upright position while bathing. The body band(s) of the strap 100 can be made of nylon or an elastic, stretchy material and vary in length depending upon the size of the user. The length can be pre-sized or can have notches to manually change the length to accommodate each individual user. The width of the strap 100 is preferably approximately one (1") inch to eight (8") inches. A suction attachment mechanism 130 (FIG. 20) secures the strap 100 to the bathtub or wall tile. One type of these suction attachment mechanism (FIG. 22) is made of rubber and has a cap 151 land a body 150 that cause adhesiveness through the mechanic of suction.

FIG. 20 depicts another embodiment of the suction attachment mechanism 130. In this embodiment, the suction attachment unit 130 is comprised of two or three small suction cups 145-147 surrounded by to or three larger suction cups 142-144. The smaller suction cups 145-147 are placed on the same plane. The first large suction cup 144 envelops the smaller suction cups 141*a-c* on the same plane. The second large suction cup 143 envelops the first large suction cup 144 and the smaller suction cups 145-147 on the same plane. Placing all suction cups within the same plane permits all of the suction bodies to touch the tub or wall tile simultaneously, thereby the air between the suction cups and the tub or wall tile surface is forced out of the suction attachment unit allowing all of the suction bodies to adhere to the tub or wall tile.

Regardless of the type of suction mechanism used, the handle 120 is attached to each suction unit 130. At each end of the strap are snaps, Velcro, or buttons 110. The ends of the straps fold around the handle 120 and the snaps, Velcro, or buttons 110 secure the strap ends around the handle or the entire suction attachment unit 130 thereby securing the user and preventing the user form sliding out of the upright position they desire.

In yet another embodiment, the straps are held in place not by a suction attachment mechanism, but by a square or circular plastic or rubber attachment part (FIG. 23) which contained a hook or handle 161 made as part of its main body 160. The plastic attachment (FIG. 23) connects to either the bathtub or wall tile by means of water-proof glue. Snaps, button, Velcro, or clips 110 are attached to each end of the strap, enfolding or hooking onto the hook or handle 120 thereby attaching the strap to the square or circular attachments. The strap then acts to hold the user stationary and prevent the user from sliding out of their desired upright position while bathing or relaxing in the tub.

Figure 24A:
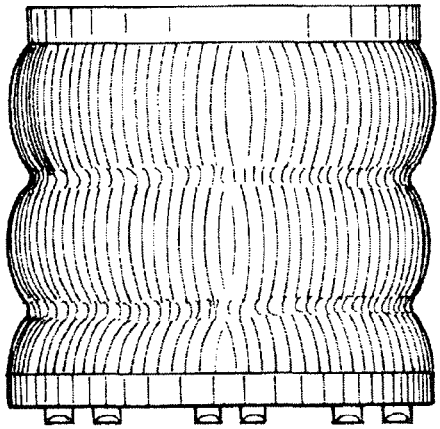
Figure 24B:
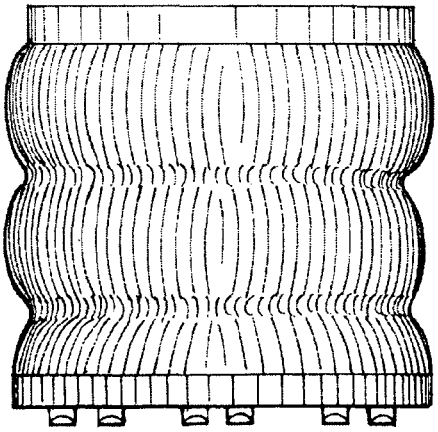
Figure 24C:
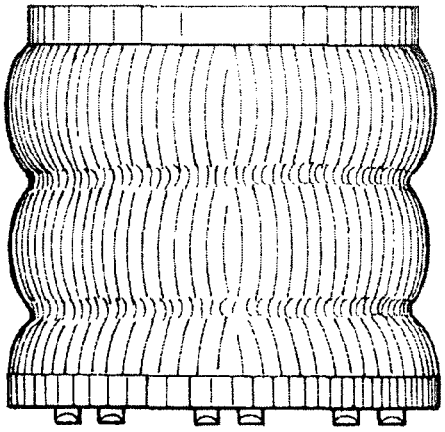
Figure 24D:
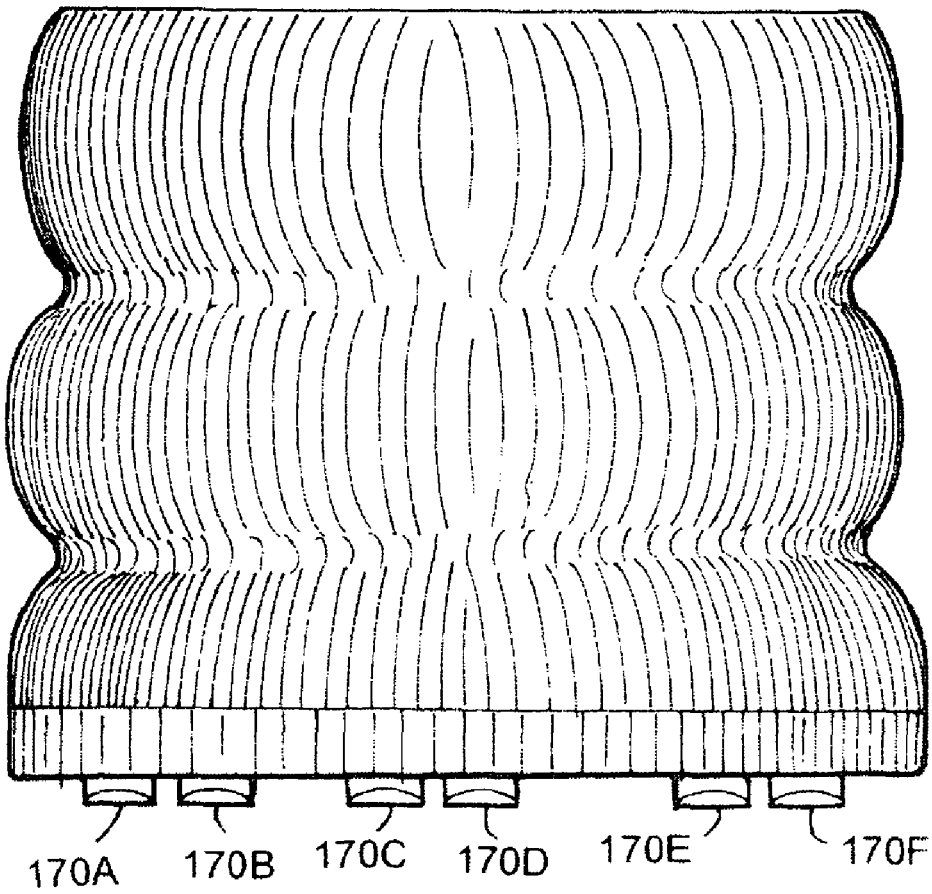
Figure 25A:
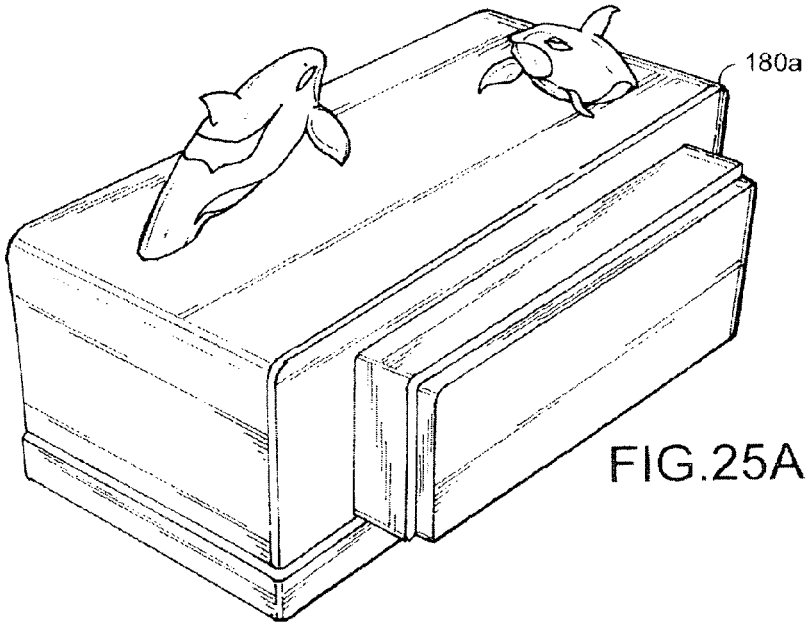
Figure 25B:
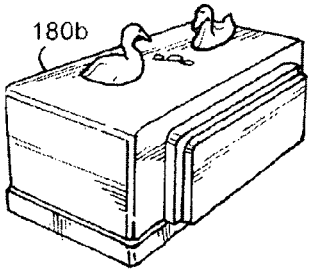
Figure 25C:
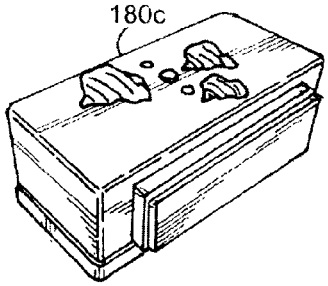
Figure 25D:
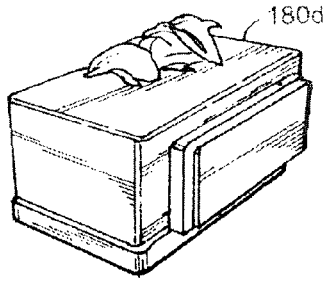

The bathtub shortener and position stabilizer 5 of the present invention can be sold individually, or in pairs or triples. Attractive as well as functional, the bathtub shortener and position stabilizer 5 can be offered in a wide variety of colors and designs to match any bathroom decor. Some examples can be seen in FIGS. 2, 12, 15, 24-24*c*, and 25-25*c*. The embodiment of the bathtub shortener and position stabilizer 5 as illustrated in FIGS. 24-24*c* functions by adding water giving the stabilizer the appropriate weight and suction cups to maintain the stablizer on the bottom surface of the bathtub.

The manner of use of the bathtub shortener and position stabilizer 5 of the present invention will now be described. It will be understood by those skilled in the art that the manner of use of the bathtub shortener and position stabilizer 5 described herein in merely one method of use and other methods of use of the bathtub shortener and position stabilizer 5 are within the scope of the present invention.

Figure 1:
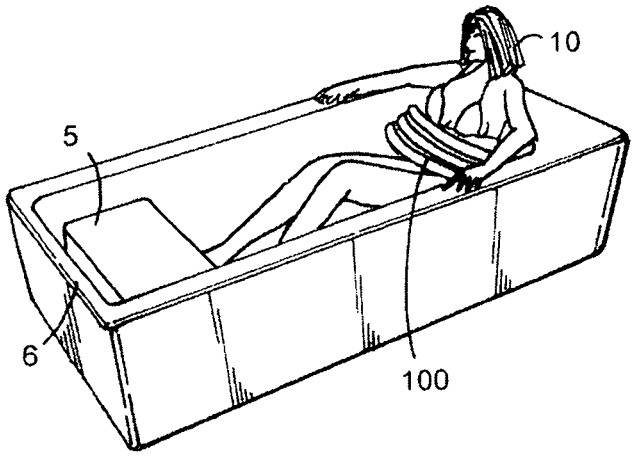
FIG. 1 is a perspective view illustrating a bathtub shortener and position stabilizer, constructed in accordance with the present invention with the bathtub shortener and position stabilizer positioned in the bathtub at the foot of the tub of an adult user.
Figure 2:
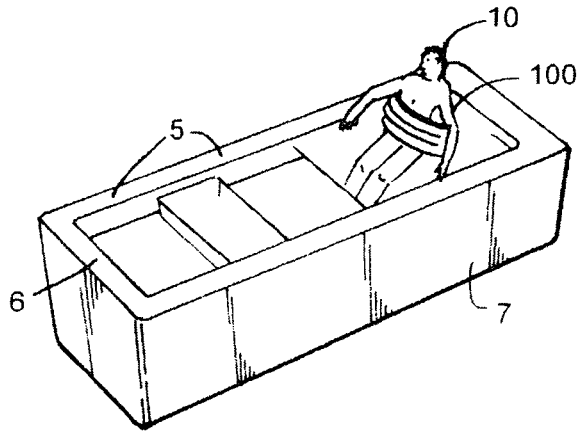
FIG. 2 is a perspective view illustrating a bathtub shortener and position stabilizer, constructed in accordance with the present invention, with two bathtub shortener and position stabilizers in the bathtub with a child user.
Figure 3:
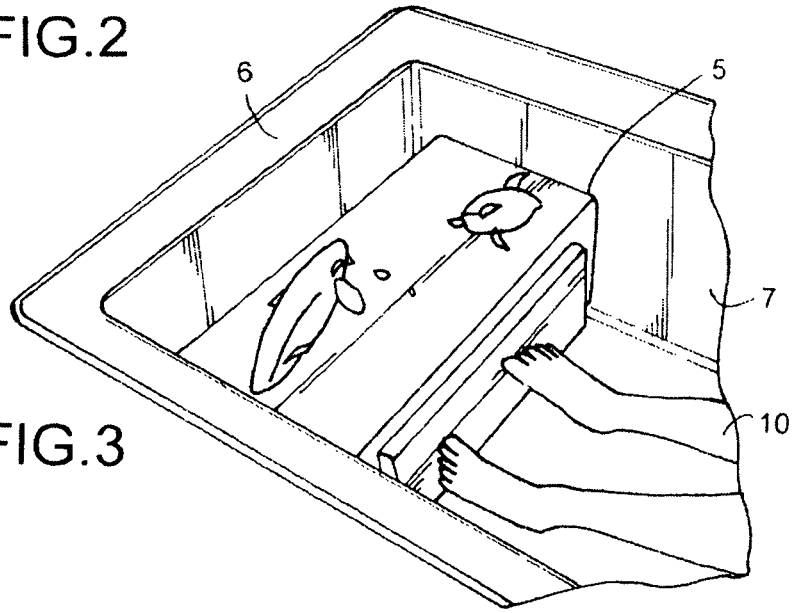
FIG. 3 is a perspective view illustrating a bathtub shortener and position stabilizer.

FIGS. 1-3 illustrate the bathtub shortener and position stabilizer 5 of the present invention in use. It consists of the main body 5 the foot rest and foot pad 23 and safety straps 100. The bathtub shortener and position stabilizer 5 and safety straps 100 may be used alone or in combination.

Use of the bathtub shortener and position stabilizer 5 of the present invention is very simple and straightforward. First, the user affixes the unit to the floor of the bathtub near the foot or at the foot of the tub. Whenever the user is ready to make it stationary the user will slightly press down on the body to cause the bottom of the bathtub shortener and position stabilizer 5 to stick to the tub by means of the built-in suction bodies that are made on the bottom (FIG. 11) or the mitt 30. Next, the user runs a bath as normal, adjusting the water temperature to the preferred settings. When settling into the tub, the user places his or her feet against the cushiony softness of the foot rest and foot pad 23 that is part of the bathtub shortener and position stabilizer 5. Lying against the head of the tub or sitting comfortably at the head of the tub, the user settles in for a leisurely bathing experience.

Even though three straps 100 are shown for each user, the number of straps 100 will be dependent upon each user's preference and need. As can be seen from these figures, the bathtub shortener and position stabilizer 5 fits at the foot end or near the foot end of a bathtub. A user place both feet against the foot rest and foot pad 23 to maintain an upright position and prevent sliding out of their desired upright position while relaxing or bathing. Some users who may have need of the straps 100 will be those lacking in proper muscle strength or muscle tone to maintain an upright position, such as the elderly and those with muscular or nervous system disorders such as Lou Gehrig's Disease (amyotrophic lateral schlerosis), Guillain-Barre Syndrome, Epilepsy, and Multiple Sclerosis to name a few. However, other users may like the comfort of using one or more straps as an extra safety measure, as when one may have a tendency to drowse while bathing.

FIG. 3 depicts one of the ways a child may use the bathtub shortener and position stabilizer 5. Depending on the height and weight or the child, there may be a need for two or even three bathtub shortener and position stabilizers 5 placed in front of each other to prevent the child from sliding from an upright position while in the bathtub. The straps 100 are highly recommended in children, especially those of toddler age.

There are many significant benefits and advantages associated with the bathtub shortener and position stabilizer 5 of the present invention. Foremost, the bathtub shortener and position stabilizer 5 affords consumers a convenient, comfortable means of basking in the pleasures of a bath. A cushiony insert that keeps the body form sliding from an upright position while in the tub, the bathtub shortener and position stabilizer 5, especially helps shorter adults as well as children to remain stationary and in a comfortable position while bathing or relaxing in the bathtub. Simple to install, the bathtub shortener and position stabilizer 5 can be affixed to a household bathtub in a matter of minutes. In addition, the practical suction attachment rings on the bottom of the mitt or the bottom help mount the bathtub shortener and position stabilizer 5 securely to the bottom surface area of the tub, effectively preventing sliding in the bathtub. This feature proves especially beneficial to the elderly and those who suffer from limited physical capabilities, allowing them to avoid possible injury while lounging in comfort and relaxing in the bathtub.

While the bathtub shortener and position stabilizer 5 was primarily conceived with household users in mind, this handy product would be ideal for use in spas and hotels, as these establishments could enhance the experience of their clients and guests with this added touch of luxury. Patients in assisted living facilities and hospital will also benefit a great deal from the use of the bathtub shortener and position stabilizer 5 and safety straps.

Lightweight yet durable, the water-resistant, heavy-duty plastic construction of the bathtub shortener and position stabilizer 5 ensures years of continued use. The bathtub shortener and position stabilizer 5 allows consumers to prolong the bathing experience, provide cushiony support for the body, and ensures safety from injury.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A bathtub shortener and position stabilizer for maintaining a user in an upright position and inhibiting the motion of sliding out of an upright position while bathing in a bathtub, the bathtub shortener and position stabilizer comprising:

a main body having at least one side wall, a top wall, and a mounting wall;

a combination foot rest and foot pad securable to one of the said at least one side wall of the main body;

securing means secured to the mounting wall of the main body for releasably securing the main body to the bathtub in a position contactable by the user;

wherein the combination foot rest and foot pad are constructed from softer material than the main body;

wherein each of the walls of the main body has an inner layer and an outer layer, the inner layer and the outer layer having space therebetween; and wherein the space between the inner layer and the outer layer is filled with a high density material.

2. The bathtub shortener and position stabilizer of claim 1 wherein the inner layer is constructed from a material different than the outer layer.

3. The bathtub shortener and position stabilizer of claim 1 wherein the combination foot rest and foot pad is releasably secured to the main body by a fastening mechanism.

4. The bathtub shortener and position stabilizer of claim 1 wherein the securing means is a plurality of suction cups.

5. The bathtub shortener and position stabilizer of claim 4 wherein the suction cups are equally positioned around the mounting surface of the main body.

6. The bathtub shortener and position stabilizer of claim 1 and further comprising:

a strap positionable in the bathtub at a predetermined distance from the main body, the strap having a suction attachment mechanism at each end for securing the strap to the bathtub.

7. The bathtub shortener and position stabilizer of claim 6 wherein each of the suction cups includes at least two inner suction cups surrounded by at least two outer suction cups, each of the inner suction cups are positioned on the same plane, one of the outer suction cups surrounding the inner suction cups, each of the outer suction cups positioned on the same plane, another outer suction cup surrounding the first outer suction cup and the inner suction cups on the same plane.

8. The bathtub shortener and position stabilizer of claim 1 and further comprising:

at least one handle secured to said at least one side wall of the main body.

9. The bathtub shortener and position stabilizer of claim 1 wherein the top wall of the base includes a lid, the lid being removable to open at least one storage compartment inside the main body.

10. The bathtub shortener and position stabilizer of claim 9 wherein the at least one storage compartment receives a quantity of liquid soap, and further comprising:

a soap dispenser pump insertable into the storage compartment.

* * * * *